US005487619A

United States Patent [19]

Winebrenner

[11] Patent Number: 5,487,619

[45] Date of Patent: Jan. 30, 1996

[54] SELF-RIGHTING WARNING MARKER

[76] Inventor: Terence M. Winebrenner, 11914 "I" St., Omaha, Nebr. 68137

[21] Appl. No.: 377,477

[22] Filed: Jan. 24, 1995

[51] Int. Cl.[6] ..... E01F 13/00

[52] U.S. Cl. ..... 404/6; 404/9; 256/13.1; 40/608; 40/ 612

[58] Field of Search ..... 404/6, 9, 10; 256/1, 256/13.1, 73; 116/63 R, 63 C, 63 P, 63 T; 40/602, 606, 608, 612; 446/325, 396; 248/188.3, 364, 910

[56] References Cited

U.S. PATENT DOCUMENTS 4,553,346 11/1985 Glasener ..... 40/602

*Primary Examiner*—Ramon S. Britts
*Assistant Examiner*—Pamela A. O'Connor
*Attorney, Agent, or Firm*—Zarley, McKee, Thomte, Voorhees & Sease; Mark D. Frederiksen

[57] ABSTRACT

A self-righting warning marker includes a base having a warning sign attached thereto and projecting upwardly therefrom. The warning sign is preferably formed of a polymer which is rigid yet resilient and flexible, to prevent breakage upon contact from a vehicle or the like. The base of the marker has a pivot surface extending between a rearward face and a bottom surface so that the marker will roll along the pivot surface from an upright orientation to a horizontal orientation if contacted by a vehicle. A ballast weight within the base is located such that the center of gravity of the marker is located forwardly of the pivot surface to thereby cause the marker to be self-righting. In a preferred embodiment of the invention, an illuminator is mounted on the marker, with a lens attached along an upper edge of the warning sign and a bundle of fiber optic cables extending through the panel of the warning sign to a power source in the base which includes a light and a battery.

11 Claims, 4 Drawing Sheets

SELF-RIGHTING WARNING MARKER

TECHNICAL FIELD

The present invention relates generally to warning signage utilized for traffic safety, and more particularly to an improved self-righting warning marker.

BACKGROUND OF THE INVENTION

Road construction has become a part of everyday life for persons using city and rural streets and highways. In order to alert the driver to various road hazards, it is conventional to utilize either large orange barrels or metal "sawhorse" type signage. Both types of conventional high traffic warning devices have their problems.

Metal sawhorse-type signage may be the most hazardous of the prior art apparatus currently utilized at construction projects. First, because the signage may be easily blown over by wind, sandbags are conventionally draped over the signage to maintain the signage in position. Such sandbags actually increase the hazard, since they become flying objects if the signage is hit by a moving vehicle. Second, the metal sawhorse signage causes damage to the vehicle, and can also be thrown into the air and through windshields or windows because of its relatively high center of gravity.

Conventional flasher units are installed on the top of the sawhorse signage, complete with battery pack and can easily be thrown from the signage if hit by a vehicle. Thus, the flasher unit also becomes a flying object which can be deadly if thrown through a windshield or window of the vehicle.

Finally, warning signage is only useful when in an upright position to warn approaching vehicles of a road hazard. Thus, once conventional metal sawhorse type signage is knocked to the ground, either by wind or by vehicles, it becomes useless as a warning marker.

Similarly, the large orange barrels which are conventional utilized as warning signage typically utilize heavy sandbags or weights on a barrel base to maintain the base into position. The barrel is then connected to the base to retain the barrel in the desired location. While the barrels are less likely to damage vehicles or the occupants of the vehicles, they are easily dismounted from their weighted base, thereby exposing the weight on top of the base to further contact by a vehicle. In addition, once the barrel has become disconnected from the base, it no longer serves as a warning sign for the particular road hazard.

SUMMARY OF THE INVENTION

It is therefore a general object of the present invention to provide an improved highway warning marker.

Another object is to provide an improved warning marker which is self-righting.

A further object of the present invention is to provide a self-righting warning marker which does not require separate weights or sandbags to maintain the marker in position.

Another object is to provide a warning marker which pivots to the ground upon impact, to eliminate airborne hazards, and automatically returns to a position enabling continued warning.

Still another object is to provide a self-righting warning marker with an illuminating light on an upper end connected to a power source in the base of the marker.

Still another object of the present invention is to provide a self-righting warning marker formed of a resilient yet sturdy material which will not harm the vehicle which contacts the marker.

A further object of the present invention is to provide an improved self-righting warning marker which is simple to use and refined in appearance.

These and other objects will be apparent to those skilled in the art.

The self-righting warning marker of the present invention includes a base having a warning sign attached thereto and projecting upwardly therefrom. The warning sign is preferably formed of a polymer which is rigid yet resilient and flexible, to prevent breakage upon contact from a vehicle or the like. The base of the marker has a pivot surface extending between a rearward face and a bottom surface so that the marker will roll along the pivot surface from an upright orientation to a horizontal orientation if contacted by a vehicle. A ballast weight within the base is located such that the center of gravity of the marker is located forwardly of the pivot surface to thereby cause the marker to be self-righting. In a preferred embodiment of the invention, an illuminator is mounted on the marker, with a lens attached along an upper edge of the warning sign and a bundle of fiber optic cables extending through the panel of the warning sign to a power source in the base which includes a light and a battery.

DESCRIPTION OF THE PREFERRED EMBODIMENT

Figure 1:
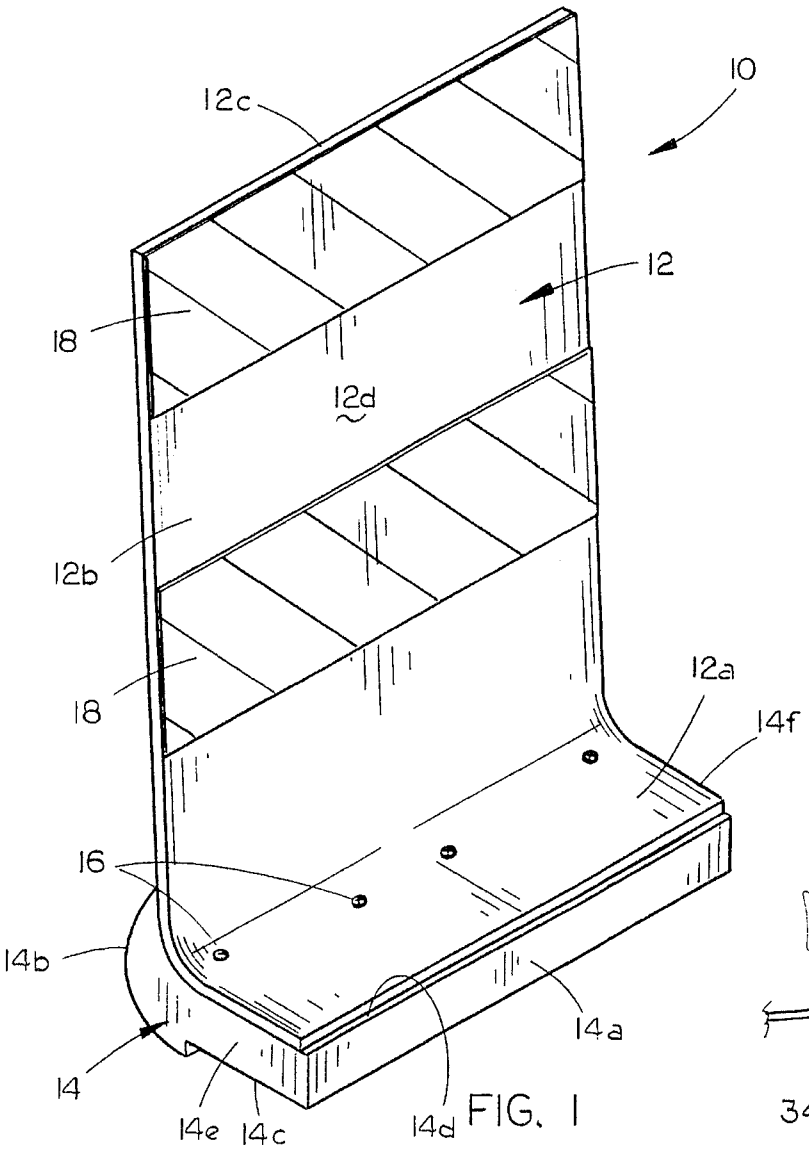
FIG. 1 is a perspective view of the warning marker of the present invention.

Referring now to the drawings, in which similar or corresponding parts are identified with the same reference numeral, and more particularly to FIG. 1, the self-righting warning marker of the present invention is designated generally at 10 and includes a resilient panel 12 formed of a resilient yet stiff material, such as a polymer, connected to a base 14 to maintain panel 12 in a generally upright orientation.

Panel 12 includes a lower portion 12*a* bent to a generally horizontal position and fastened to base 14 with screws 16, or other fasteners, and an upper portion 12*b* projecting upwardly to an upper edge 12*c*. Printed indicia 18 of preferably reflective material, is affixed to at least the forward face 12*d* of upper portion 12*b* of panel 12, in predetermined locations, to alert drivers of various hazards.

Figure 2:
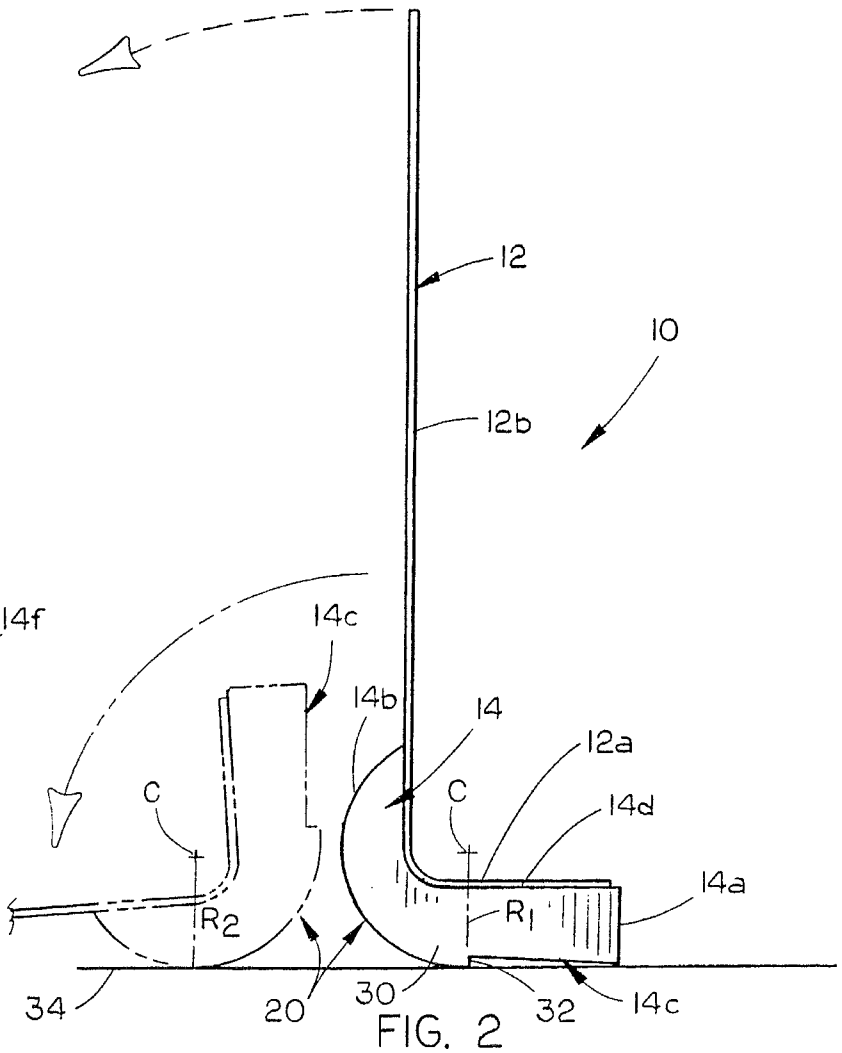
FIG. 2 is a side elevational view showing the marker in an upright position and a horizontal position.

Referring now to FIG. 2, base 14 of warning marker 10 includes a forward surface 14*a*, a rearward surface 14*b*, a bottom surface 14*c*, a top surface 14*d*, and opposing ends 14*e* and 14*f* (as shown in FIG. 1). Panel 12 has its lower portion 12*a* affixed to the upper surface 14*d* of base 14 with upper panel portion 12*b* projecting generally vertically, when warning marker 10 is in the upright position shown in solid line in FIG. 2. Base rearward surface 14*b* is continuously curved to adjoin bottom surface 14*c* at a tangent, and thereby form a pivot surface identified generally at 20. As shown in FIG. 2, warning marker 10 will pivot or "roll" along pivot surface 20 between an upright position, shown in solid lines, to a "knocked down" or horizontal position, shown in broken line in FIG. 2.

Figure 3:
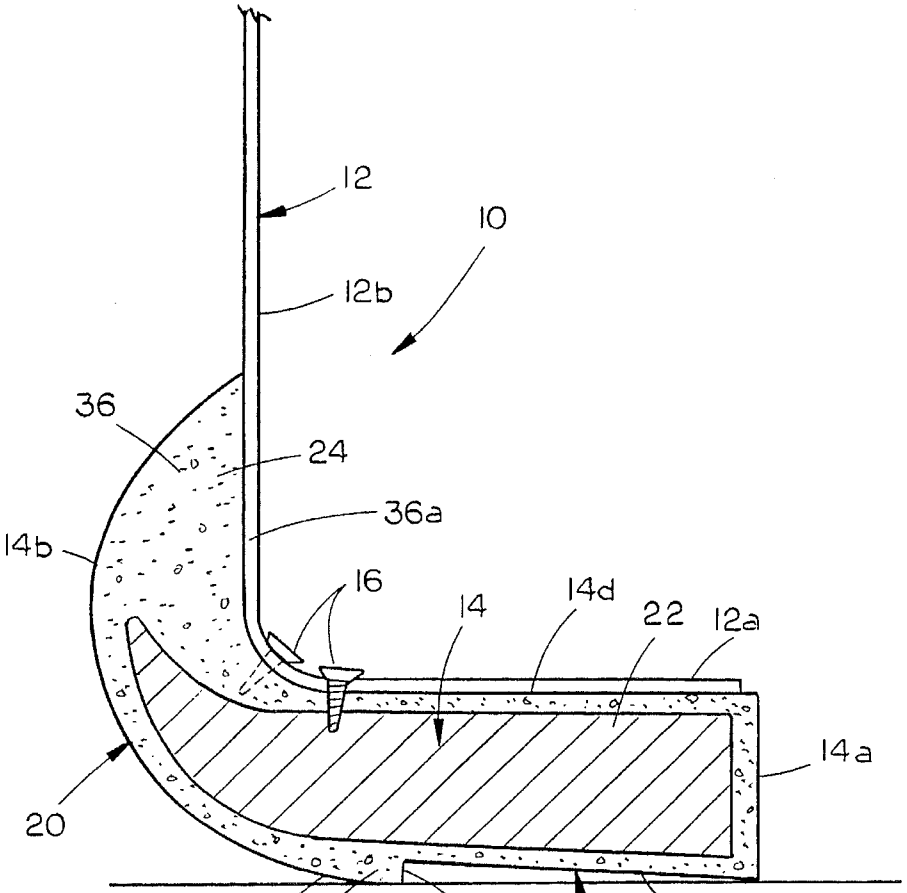
FIG. 3 is a vertical sectional view through the base of the marker.

Referring now to FIG. 3, base 14 preferably includes an iron ballast weight 22 completely encased within a housing 24 formed of a rubber material, such as tire shavings and buffings. The ballast weight 22 has its surface worked to form a plurality of small holes thereon, thereby permitting the rubber housing 24 to permeate and properly grip the ballast weight 22. The various base surfaces 14*a*–14*f* are then finished to a smooth surface. As shown in FIG. 3, panel 12 is mounted with lower portion 12*a* affixed with screws 16 to the upper surface 14*d* of housing 24.

Bottom surface 14*c* includes a forward portion 26, extending rearwardly from forward surface 14*a*, and a rearward portion 28 formed on the bottom of a depending heel 30. Heel 30 includes a generally forward wall 32 separating the forward portion 26 from the rearward portion 28 of bottom surface 14*c*. Pivot surface 20 preferably extends continuously from rearward surface 14*b* to the forward wall 32 of heel 30, tangential with rearward portion 28 of bottom surface 14*c*, to roll smoothly along pivot surface 20.

Ballast weight 22 is shaped so as to provide an overall center of gravity for warning marker 10 located forwardly of a vertical line $R_1$ aligned along a radius of pivot surface 20 extending through center point C, with forward wall 32 of heel 30, as shown in FIG. 2. Thus, when warning marker 10 is in the upright orientation shown in solid line in FIG. 2, the center of gravity is located between forward surface 14*a* and line $R_1$, to bias warning marker 10 to maintain the upright position. Similarly, the center of gravity of warning marker 10 is located spaced from radius line $R_2$, towards bottom surface 14*c*, when warning marker 10 is in the horizontal position shown in broken lines. Radius $R_2$ is a line extending from center point C perpendicular to the ground 34 where pivot surface 20 is tangent to ground 34. In this way, the center of gravity will continuously maintain a biasing force, the force of gravity, which attempts to "roll" base 14 forwardly along pivot surface 20 to the upright position shown in solid lines in FIG. 2.

Referring once again to FIG. 3, housing 24 preferably includes an upwardly projecting leg 36 located at the rearward end of the base top surface 14*d*, which provides a vertically oriented forward wall 36*a* upon which the upper portion 12*b* of panel 12 may be mounted to assist in maintaining an upright orientation relative to panel lower portion 12*a*.

Figure 4:
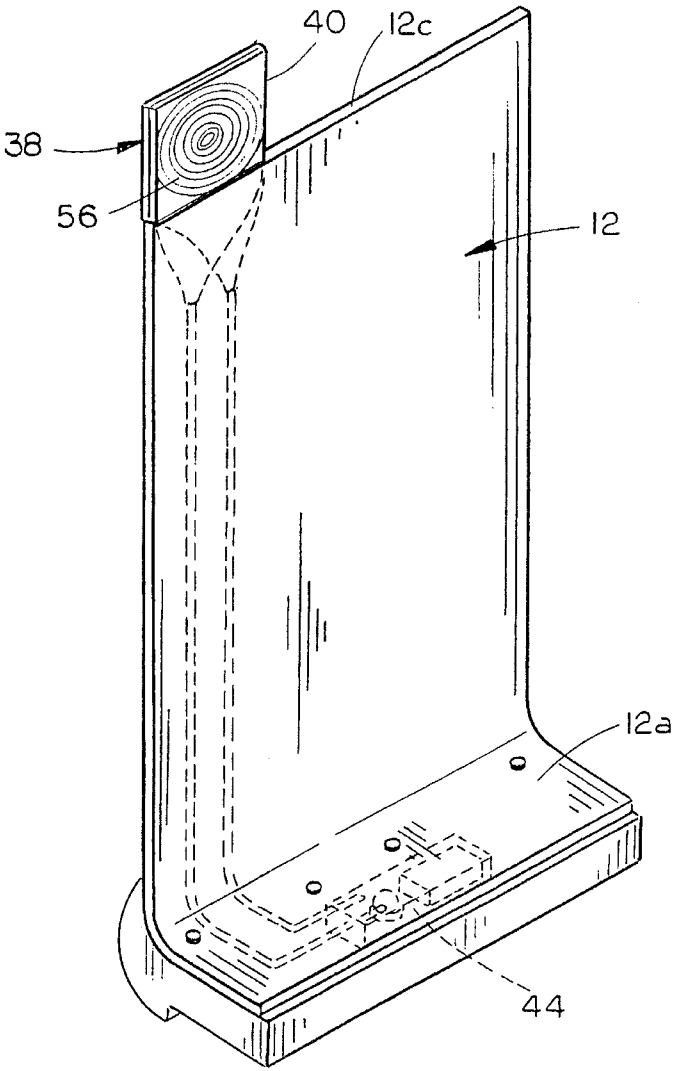
FIG. 4 is a perspective view of a marker with an illuminator mounted thereon.
Figure 5:
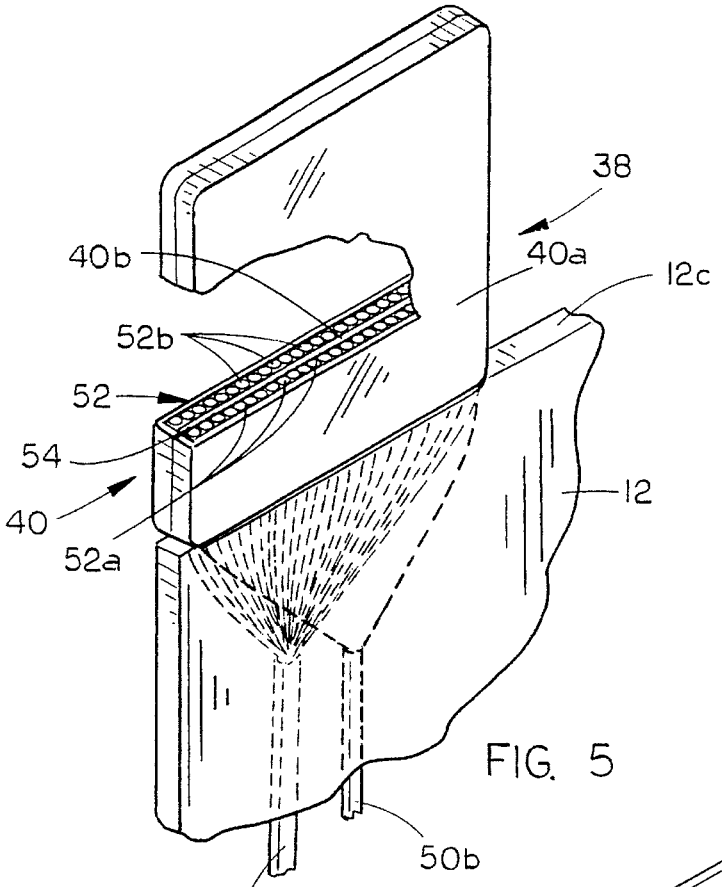
FIG. 5 is an enlarged perspective view of the illuminator for the marker shown in FIG. 4.
Figure 6:
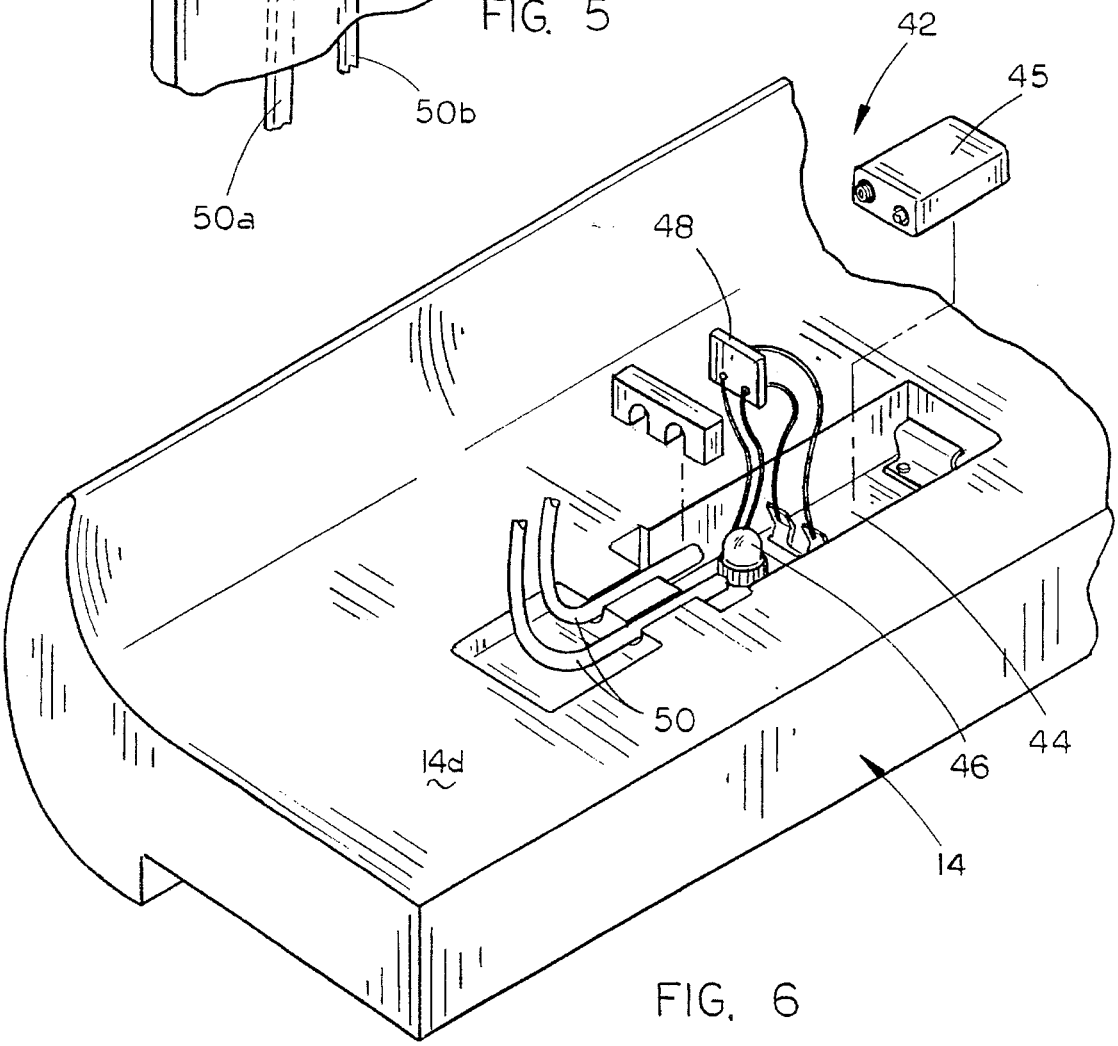
FIG. 6 is an enlarged perspective view of the base of the marker of FIG. 4.

Referring now to FIG. 4, an illuminator 38 of various kinds may be attached to the upper edge 12*c* of panel 12 to provide a visual flashing warning in the darkness. As shown in FIGS. 5 and 6, the preferred embodiment of illuminator 38 includes a lens portion 40 attached to the upper edge 12*c* of panel 12 and connected to a power source 42 mounted within a cavity 44 in the top surface 14*d* of base 14. Power source 42 includes a battery 45 and a light bulb 46, which are electrically connected through a control box 48 to provide a selectively flashing light source to bundles 50 of fiber optic cables 52. Fiber optic cables 52 thereby conduct light to lens 40, which then emits the light outwardly therefrom. As shown in FIG. 4, cavity 44 is sealed by panel lower portion 12*a*, to maintain power source 42 in a sealed, weather-tight compartment.

Recent resin technology permits the construction of panel 12 of a polymer, which permits fiber optic cable bundles 50*a* and 50*b* to be directly embedded within panel 12 during the manufacture thereof. The fiber optic cables 52*a* and 52*b* of bundles 50*a* and 50*b*, respectively, project upwardly out of upper edge 12*c* of panel 12 and into lens 40, as shown in FIG. 5. Fiber optic cables 52*a* are aligned parallel to one another within lens 40 within a vertical plane and disposed on one side of a while mylar adhesive reflector 54, and affixed within lens 40 in a conventional fashion to produce light which is reflected by reflector 54 and directed outwardly from reflector 54. The second set of fiber optic cables 52*b* are arranged in a similar fashion on the opposite side of reflector 54 to emit light in the opposite direction. Preferably, fiber optic cables are positioned and affixed within lens 40 in a conventional fashion to transmit light emitted from light bulb 46 (shown in FIG. 6) and to direct that light outwardly from lens 40. A clear mylar forward wall 40*a* of lens 40 protects fiber optic cables 52*a*, while a rearward clear mylar wall 40*b* serves the same purpose. As shown in FIG. 4, a series of grooves 56 may be formed in lens 40 to direct light emitted therefrom, in the fashion of a Fresnel lens.

Figure 7:
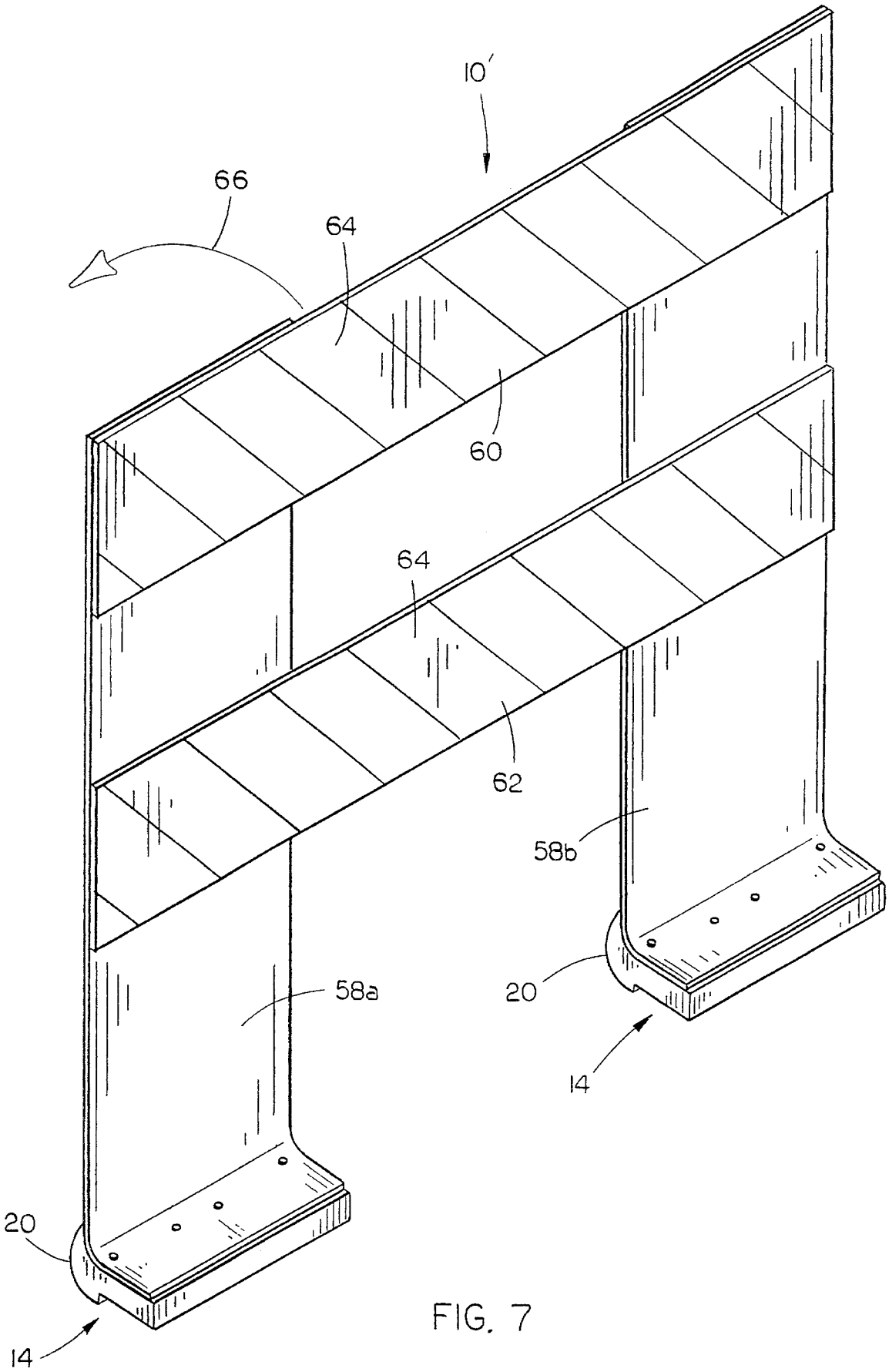
FIG. 7 is a perspective view of a second embodiment of the invention.

Referring now to FIG. 7, a second embodiment of the warning marker is designated generally at 10' and utilizes a pair of bases 14 spaced apart and aligned with one another, with a pair of panels 58*a* and 58*b* projecting upwardly therefrom to form the legs of marker 10'. A pair of cross-members 60 and 62 interconnect panels 58*a* and 58*b* to form a marker 10 having printed indicia 64 imprinted thereon to warn motorists of potential road hazards.

As with the first embodiment of the invention, warning marker 10 will pivot to a horizontal position, indicated by arrow 66, about pivot surfaces 20, if contacted by a vehicle of the like. Bases 14 are designed such that the center of gravity of warning marker 10' is located to return warning marker 10' to the upright position, in the same fashion as the first embodiment of the invention.

Whereas the invention has been shown and described in connection with the preferred embodiments thereof, many modifications, substitutions and additions may be made which are within the intended broad scope of the appended claims.

I claim:

1. A self-righting warning marker, comprising:

a base having a forward surface defining a free end thereof, a rearward surface, opposing left and right ends, and opposing top and bottom surfaces;

said rearward surface adjoining a portion of the bottom surface along an arcuate pivot surface, means providing pivotal movement of the marker from to a substantially horizontal orientation to an upright orientation, the horizontal orientation having the rearward surface in contact with ground and the top and bottom surfaces generally perpendicular thereto;

a warning sign attached to said base and extending upwardly therefrom oriented generally perpendicularly to the base bottom surface;

said warning sign having indicia thereon for visually alerting a person located forwardly of the marker;

said warning marker having a center of gravity located to cause the base to be biased to an upright orientation from the horizontal orientation, pivoting along said pivot surface;

said base bottom surface having a forward edge located to stop pivotal movement of the base from the horizontal position beyond a predetermined upright position.

2. The warning marker of claim 1, wherein said means comprises said base bottom surface having a heel portion depending therefrom and extending from side to side, with a heel forward edge located between the center of gravity of the marker and the base rearward surface, whereby the center of gravity is spaced from said heel forward edge in a direction toward said free end the following has been inserted between.

3. The warning marker of claim 2, wherein said heel includes a bottom surface extending from said heel forward edge to a tangent with said pivot surface.

4. The marker of claim 1, wherein said warning sign includes a panel of flexible, resilient, weather resistant material connected at a lower end to said base and having stiff characteristics to project upwardly therefrom, said panel having an upper edge.

5. The marker of claim 4, further comprising an illuminator connected to the panel upper edge, operable to selectively emit light, and a power source connected to the illuminator.

6. The marker of claim 5, wherein said power source is removably mounted on said base, and further comprising a conductor operably connected between the power source and the illuminator for conducing power for illuminating the illuminator.

7. The marker of claim 6, wherein said conductor is embedded in said panel from a position adjacent the power source to a position adjacent the illuminator.

8. The marker of claim 6, wherein said illuminator includes a lens for conducting and distributing light from a light source, wherein said conductor is a fiber optic cable for transmitting light from the power source to the lens, and wherein said power source includes a light source and an electrical source selectively connected to the light source to activate the same.

9. The marker of claim 8, wherein said base includes a cavity formed in the top surface thereof, and wherein said power source is removably mounted within said cavity.

10. The marker of claim 9, wherein said panel includes a lower portion oriented generally perpendicularly to an upper portion, the lower portion being removably mounted to the upper surface of the base, and covering said cavity to seal the cavity from weather.

11. The marker of claim 8, wherein said light source and power source are sealed from weather on said base.

* * * * *